United States Patent [19]

Schultz

[11] 4,023,717

[45] May 17, 1977

[54] PRESSURE-OPERATED CONTAINER FOR VISCOUS PRODUCTS

[76] Inventor: Robert S. Schultz, 7 Heusted Drive, Old Greenwich, Conn. 06870

[22] Filed: Sept. 24, 1975

[21] Appl. No.: 616,363

Related U.S. Application Data

[63] Continuation-in-part of Ser. No. 459,328, April 9, 1974, abandoned.

[52] U.S. Cl. ..... 222/386.5; 222/389

[51] Int. Cl.[2] ..... B67D 5/54

[58] Field of Search ..... 222/386, 386.5, 387, 222/389; 239/323; 92/246, 247

[56] References Cited

UNITED STATES PATENTS

| | | | |
|---|---|---|---|
| 3,066,836 | 12/1962 | Trumbull | 222/389 X |
| 3,099,370 | 7/1963 | Hein | 222/386.5 |
| 3,132,570 | 5/1964 | Hoffman et al. | 222/389 X |
| 3,132,774 | 5/1964 | Soffer | 222/402.22 |
| 3,147,753 | 9/1964 | Nogier et al. | 92/247 X |
| 3,381,863 | 5/1968 | Towns | 222/389 X |
| 3,745,890 | 7/1973 | Costarella | 92/246 X |
| 3,827,607 | 8/1974 | Schultz | 222/389 |

*Primary Examiner*—Robert B. Reeves
*Assistant Examiner*—Francis J. Bartuska
*Attorney, Agent, or Firm*—Hopgood, Calimafde, Kalil, Blaustein & Lieberman

[57] ABSTRACT

The invention contemplates a pressurized container for viscous foods or other viscous products in which the body of the piston includes an axially intermediate flexible circumferential band which lightly contacts or is expandable in the presence of loading pressure exerted by propellant gas. The band thus develops light sealing contact with the interior wall surface of the container, and such contact effectively isolates unexpelled product from the gas-pressure side of the piston, regardless of the extent to which product has been expelled.

37 Claims, 7 Drawing Figures

PRESSURE-OPERATED CONTAINER FOR VISCOUS PRODUCTS

This application is a continuation-in-part of my copending application, Ser. No. 459,328, filed Apr. 9, 1974 now abandoned.

The present invention relates to a pressure-packaging system for viscous products and particularly to a piston construction for a pressurized container.

Highly effective piston valve and container relationships of the character indicated are disclosed in my application Ser. No. 290,977 (now U.S. Pat. No. 3,827,607, issued Aug. 6, 1974). In said patent, the piston is characterized by a resilient flange member, spaced from the tubular body of the piston and responsive to pressure-loading, to maintain a light sealing pressure on the interior wall surface of the container. This construction, although effective, does present some complexity in the molding techniques needed to make each piston as a single integral product of plastic injection molding.

It is, accordingly, an object to provide an improved construction of the character indicated, lending itself to inherently simpler and less costly fabrication.

Another object is to achieve the above object with little or no sacrifice in operating effectiveness.

It is a specific object to produce a simpler piston for achieving smooth discharge flow in a container of the character indicated.

A specific object is to achieve the foregoing objects in a valved pressure container having a piston operable therein in which the viscous product is in the valved end of the container and ahead of the piston while a gas, such as nitrogen, is introduced under pressure behind the piston to urge the latter against the product and expel the product through the valved opening.

Another specific object is to provide in such a container a piston and seal construction which permits the piston to operate smoothly within the container in spite of any piston expansion, as may be caused by piston absorption of oils present in the viscous product to be dispensed.

A further specific object is to provide an improved container of the character indicated wherein viscous product may be loaded through the bottom of the container and in direct void-free relation with the valve.

Another specific object is to provide an improved piston construction for a container of the character indicated wherein viscous product is loaded from the top end of the container and against the piston and yet wherein smooth piston action is not adversely affected by the fact of such top loading.

A general object is to achieve the foregoing objects with a construction which inherently simplifies container assembly, which operates smoothly and without piston bind even if the container has been so abused as to have side-wall indentations.

Other objects and various further features of novelty and invention will be pointed out or will occur to those skilled in the art from a reading of the following specification, in conjunction with the accompanying drawings. In said drawings.

Figure 1:
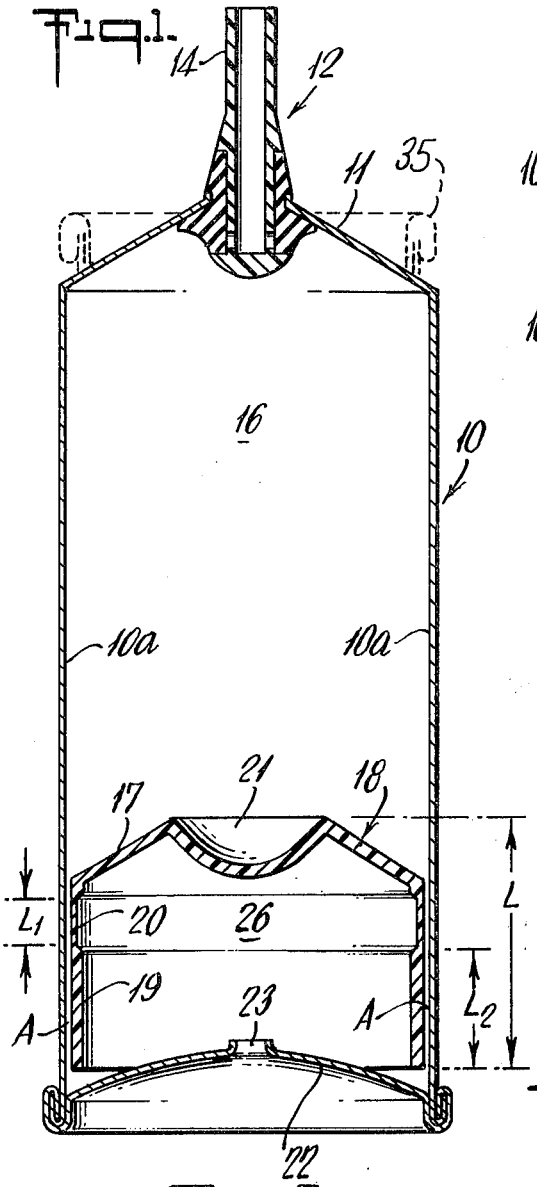
FIG. 1 is a longitudinal sectional view of a container of the invention, shown in unpressurized condition.
Figure 2:
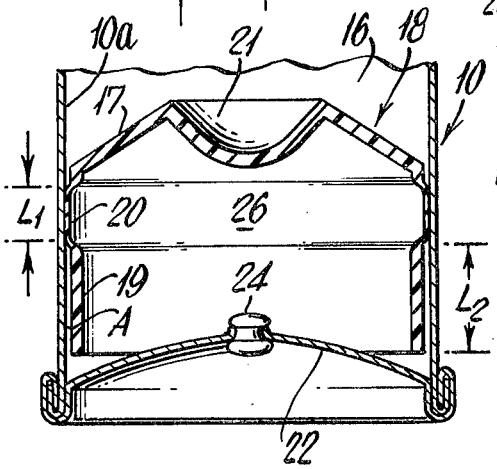
FIG. 2 is a fragmentary view similar to FIG. 1, to show a different parts relationship, under pressurized conditions.

Referring to FIGS. 1 and 2, a pressurized container or can 10 is formed with an integral conical top-end wall 11 and provided with a valve, referred to generally by the reference numeral 12. The valve 12 is of the variety in which a valve stem 14 is pressed laterally in a well-known manner in order to release the valve seal and permit the viscous product 16, which is at superatmospheric pressure, to be expelled to the atmosphere. It is to be noted that the container and valve per se form no part of the present invention; however, particular cooperating relationships between these and other parts are regarded as inventive.

In accordance with a feature of the invention, a generally tubular hollow piston 18, which may be constituted of a low density polyethylene or a polypropylene material, is used to drive product 16 through the dispensing valve 12. Secured to or integral with upper and lower parts 17–19 is a relatively thin and resilient flexible circumferential band 20 of large external surface area and predetermined effective axial length $L_1$, for example 15 to 35 percent, of the overall axial extent L of piston 18. The upper part 17 is conical, in conformance with the conical shape of end wall 11, and is relatively thick and stiff, having a central generally spherical concavity 21 adapted for close fit to the generally convex spherical contour of the dispensing-valve member when product is fully dispensed, conical surfaces 11–17 being in contact. The lower part 19 is cylindrical and may be viewed as a less flexibly yieldable second circumferential band of predetermined length $L_2$ near the open end of the piston. Generally, the thickness of the flexible band 20 is in the order of 0.005 to 0.015 inch and is less than one half the wall thickness of the less flexible band 19, and the more flexible length $L_1$ approximates but is preferably less than the less flexible length $L_2$.

Stated in other words as to flexibility, the nature and dimensions of the more flexible band 20 are such, in relation to the container wall surface 10*a*, that dependable but light sealing contact is provided with the container wall surface 10*a*, in the presence of propellant-gas pressure within piston 18. Also, under such pressure, the nature and dimensions of the less flexible band 19 are such that no circumferentially continuous contact thereof is established with wall surface 10*a*.

The container 10 is closed by a bottom wall 22 having a central opening 23 for reception of a sealing grommet 24. Propellant gas 26, such as nitrogen, is introduced via opening 23 after viscous product 16 and piston 18 are inserted into the container, and grommet 24 completes the sealed closure under pressure. If the unstressed clearance A between piston band 20 and container wall 10*a* is small, e.g., zero to 0.010 inch, then rapid application of pressure-gas loading immediately inflates the flexible band into sealing contact with wall 10*a*, squeezing back into the product zone 16 any product which may have entered the clearance; thereafter, surface tension of the product, surface-wetting by the product of adjacent sealing surfaces 10*a*–20, and continued gas-pressure loading all combine to assure maintenance of a sealed relationship and therefore an effective non-contaminating isolation between the product chamber 16 and the gas chamber 26, throughout the life of the container, i.e., as long as product remains to be dispensed. At the same time, by reason of its less flexible property, the lower band 19 remains in clearance relation with wall 10*a*, as suggested at A in FIG. 2, so that the flexible band 20 is the only means of piston suspension in a loaded container.

FIG. 2 also serves to illustrate an embodiment in which, in unstressed condition, the circumferential extent of flexible band 20 is substantially equal to or slightly greater than the peripheral extent of the container wall surface 10*a*, thus establishing very light frictional contact of these parts upon assembly; of course, such circumferential contact is to the exclusion of circumferential contact by the lower and less flexible band 19, as suggested by clearance A, to denote the lesser circumferential extent of band 19.

It will be noted that the space A, which permits easy loading and operation of piston 18 in container 19, functions to provide room for lateral expansion of less flexible piston parts 17–19, especially when oily-type or flavored products are loaded in the container, the expansion of these parts being due to absorption of product oils. With such absorption and expansion, the more resilient band 20 readily adapts by further flattening (i.e., larger-area contact) with the container wall 10*a*; however, light sealing pressure continues to characterize its resilient contact, sealing propellant from product, while permitting piston 18 and product to move smoothly as product is dispensed by valve means 12; the nature of resilient band 20 is to flex in and out of any indentations and over any projecting or other imperfections that might be present on the interior wall surface 10*a*.

Figure 3:
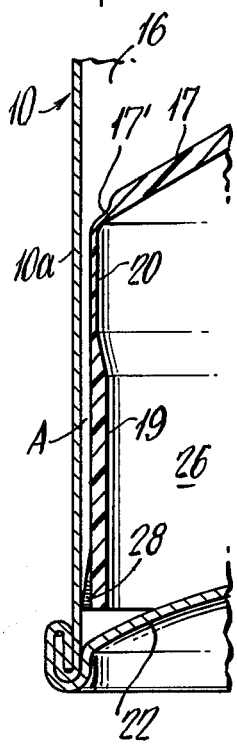
FIGS. 3 and 4 are enlarged fragmentary sectional views to show modifications.
Figure 4:
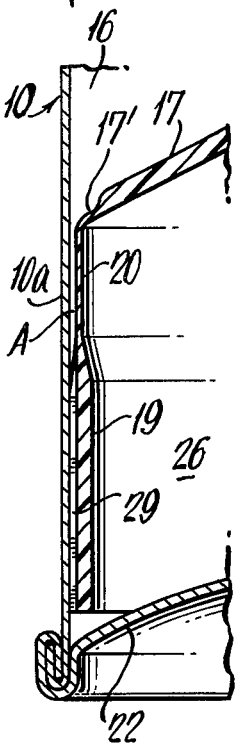

FIG. 3 shows a modification in which a plurality of angularly spaced longitudinally extending ribs or skids 28 are integrally formed in the outer wall of band 19, near the base end of the piston. As depicted, these skids are wedge-shaped, for non-fouling piston-stabilizing contact with the container wall. for a 1-inch diameter piston, three or four of such equally spaced skids 28 are deemed adequate; for larger pistons greater numbers may be needed. FIG. 4 shows a further modification in which skids 29 are provided as in FIG. 3 but of longitudinal extent approximating the length $L_2$ of the less flexible band 19. FIGS. 3 and 4 also illustrate a modified feature of relief at the corner 17′, whereby the relatively thin band 20 effectively extends around the forward circular corner 17′, thereby rendering piston contact with the container wall more softly flexible and hence, more readily adaptable to ride past bumps or other local discontinuities in the container wall.

Figure 5:
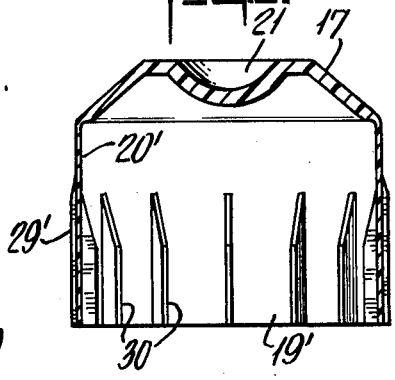
FIGS. 5 and 6 are respectively sectional and perspective views of a piston construction, representing further modification.
Figure 6:
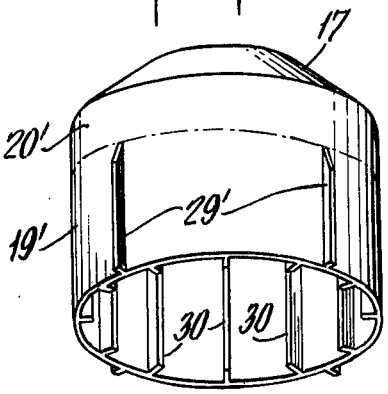

In the piston of FIGS. 5 and 6, a single relatively thin cylindrical wall thickness serves both the inflatable resilient band 20′ and the less flexible band 19′. Band 19′ is rendered less flexible by provision of a plurality longitudinally elongate radially inward stiffening ribs 30, and is of course additionally stiffened by external skid formations 29′, as described in connection with FIG. 4. Inflation, sealing, and stabilizing functions are as previously described.

The structure thus far described has involved a container 10 in which the top end wall is integral with the cylindrical body, all to enable bottom-filling of the inverted container body via its open bottom, prior to piston assembly, bottom closure and gas pressuring. The invention is also equally applicable in top-filling applications, wherein the bottom panel 22 is an integral part of the cylindrical body of the container and wherein the conical top-end panel 11 (with its valve means 12) is a separate subassembly, secured to the container body after piston insertion and product filling via the open top; separate connection of such a top-filled construction is suggested by a phantom outline of a chime connection at 35 in FIG. 1.

In top-filling applications of the invention, it will be appreciated that the weight of product loaded over the closed end 17 of the piston will first drive the piston skirt 19 into contact with the container bottom and will then so incrementally axially compress and radially outwardly urge the thin resilient band region 20 as to lightly radially outwardly load the same into assured circumferentially continuous sealing contact with the container wall. Such contact remains while the top end (with its valve 12) is chime-connected, to close the top end over the loaded product. And subsequent gas-pressurizing and sealing at 24 merely pressure-loads the band 20 to assure continued large-area contact with the container wall, throughout the dispensable-product life of the container.

Figure 7:
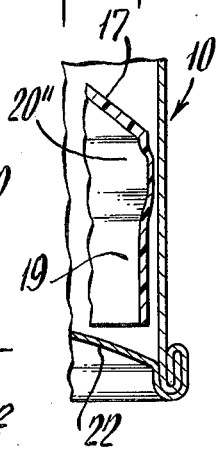
FIG. 7 is a fragmentary view similar to that at the lower right-hand portion of FIG. 1, to show still further modification.

The modification of FIG. 7 will be recognized for its general similarity to FIG. 1, except that FIG. 7 is shown in the unstressed condition; and when pressure inflated the embodiment of FIG. 7 will present the appearance of FIG. 2, in relation to the container wall. Specifically, the piston of FIG. 7 comprises a first relatively thin and expandable flexible cylindrical band 20″ of unstressed external peripheral extent which exceeds the peripheral extent of the second band 19″, so that under pressurized conditions, the peripherally continuous light sealing contact with the container wall is definitely limited to the first band 20″, and the second band can be assuredly limited to stabilizing contact with the wall, i.e., less than peripherally continuous. Generally, I prefer that the difference in maximum peripheral extents of bands 20″–19″, in the unstressed state, shall be relatively small, as for example in the order of 0.005 to 0.010 inch for a 1.5-inch container-bore diameter. Also, generally speaking, for the polyethylene and polypropylene materials indicated as preferable, the typical design relation for the maximum unstressed peripheral extent of the first band 20″ is in the range of zero to 0.030-inch less than the bore periphery of the container wall.

The invention will be seen to have achieved all stated objects, with inherent simplicity and economy of parts, their assembly, and their construction. Wedge formations on stabilizing ribs 28–29 aid removability from the piston wall, and they also assure against any substantial circumferential arc of engagement of the lower end of the piston with the container wall.

While the invention has been described in detail for the preferred forms shown, it will be understood that modifications may be made without departure from the claimed invention.

What is claimed is:

1. A piston for a pressurized container having a viscous product and provided with a dispensing valve, said piston being a single injection-molded plastic article and comprising a piston body of generally tubular configuration and closed at its upper end and open at its lower end, the tubular portion of said piston body comprising a relatively thin resiliently expandable first circumferential band of large continuously smooth surface area and predetermined axial length near said closed end and a less flexibly expandable second circumferential band of predetermined axial length near the open end, said bands being serially continuously formed and axially connected to comprise and define substantially the entire axial length of the tubular portion of said piston body, and said first being substantially more axially extensive than its radial thickness; whereby, with said piston in a suitable product-loaded container wherein said second band has short clearance with the inner wall of the container, and when the space beneath the piston is subjected to a predetermined charge of gas under pressure, said first band will be expanded into pressure-loaded peripherally and axially continuous light sealing and stabilizing contact with the container wall and said second band will have less than circumferentially continuous stabilizing contact with the container wall.

2. The piston of claim 1, wherein the thickness of said first band is less than half the thickness of said second band.

3. The piston of claim 1, wherein the thickness of said first band is in the range of 0.005 to 0.015 inch.

4. The piston of claim 1, wherein in unstressed condition said bands have external cylindrical surfaces, the radius of said first band exceeding that of said second band.

5. The piston of claim 4, wherein the inner wall at said first band is recessed in relation to the inner wall at said second band, to an extent substantially exceeding the amount by which the external radius of said first band exceeds the external radius of said second band.

6. The piston of claim 1, wherein in unstressed condition said bands have a single external cylindrical wall surface in common, the corresponding inner wall at said first band being recessed in relation to the inner wall at said second band.

7. The piston of claim 1, wherein in unstressed condition said first band is characterized by an outer generally cylindrical wall of peripheral extent exceeding that of said second band.

8. The piston of claim 1, in which said second band is integrally formed with plural angularly spaced radially short outward projections for correspondingly spaced stabilizing contact with the container wall.

9. The piston of claim 8, in which each said projection is a longitudinal ridge formation in the outer surface of said second band.

10. The piston of claim 9, in which each said projection extends substantially the longitudinal extent of said second band.

11. The piston of claim 1, in which said bands are of substantially the same thickness throughout their combined axial extent, said second band to the exclusion of said first band having plural angularly spaced longitudinal stiffening ribs.

12. The piston of claim 11, in which said ribs project inwardly of the inner wall surface of said second band.

13. The piston of claim 11, in which said ribs project outwardly of the outer wall surface of said second band, thereby providing both stiffening and piston-stabilizing functions.

14. In combination, a pressure container comprising an elongate cylindrical body with a closed upper end, dispensing-valve means in said upper end, a one-piece molded piston of resiliently deformable material and integrally including a closed upper end and a tubular body structure extending downwardly within the cylinder of the container wall and united to the closed end of said piston, said tubular body structure comprising a relatively thin resiliently expandable first circumferential tubular band of large continuously smooth surface area and predetermined axial length near said closed upper end and a less flexibly expandable second circumferential band of predetermined axial length near the open end, said bands being serially continuously formed and axially connected to comprise and define substantially the entire axial length of the tubular portion of said piston body, and said first band being substantially more axially extensive than its radial thickness; a viscous product in the space between said piston and valve means, pressure-sealing means closing the lower end of said container to define a pressure chamber beneath said piston, and a predetermined charge of gas under pressure in the pressure chamber and pressure-loading said first band into peripheral and axially continuous light sealing and stabilizing contact with the container wall.

15. The combination of claim 14, in which said first band is the only means of piston suspension with respect to the container wall.

16. The combination of claim 14, in which said first band has an unstressed external periphery of substantially the inner wall-surface peripheral extent of the container body, and in which said second band has an unstressed external periphery less than that of said first band.

17. The combination of claim 14, in which said second band has an external periphery which under pressure-loading is less than the inner wall-surface peripheral extent of the container body.

18. The combination of claim 17, in which integral stabilizing skids project from the outer surface of said second band in angularly spaced stabilizing-contact relation with the inner wall surface of the container body.

19. The combination of claim 14, in which said container body has a top opening, said dispensing-valve means being assembled to said body at the top opening after dispensable product is loaded through the opening.

20. The combination of claim 14, in which said container body has a bottom opening and a bottom panel for closing the container after said piston is assembled to product loaded through the open bottom of the container.

21. The combination of claim 14, in which said closed upper end of said container is a conical reduction from said cylindrical body to a central valve-locating opening.

22. The combination of claim 21, in which the slope of the conical reduction is in the range of substantially 35° to substantially 55° off the container-body axis.

23. The combination of claim 15, in which said valve means comprises a resilient bushing having a central body and an integral conical flange generally conforming to the inner surface of the conical reduction of the container and periphery continuously sealing said bushing to the container, and a headed dispensing-valve member having a stem portion extending through said bushing and located thereby.

24. The combination of claim 23, in which said central body projects downwardly and radially clear of the lower end of said conical flange, said head seating against said central body and radially clear of said conical flange, whereby said conical flange is relatively free to maintain the sealed relationship to said container while accommodating eccentric-displacement forces upon tilted actuation of said stem portion.

25. The combination of claim 21, wherein the upper wall-surface contour of the closed end of said piston includes an outer frusto-conical annulus of slope conforming to that of said conical reduction.

26. The combination of claim 21, wherein the portion of said valve means exposed internally of said container is characterized by a central convex spherical contour, and wherein the upper surface of the closed end of said piston is characterized by a central spherical concavity substantially matching the said convex contour.

27. The combination of claim 26, wherein said valve means includes a resilient bushing carried at the container end-wall opening and a headed dispensing stem extending through said bushing with the head seated against the axially inner end of said bushing, said head having convex spherical surface of radius in the order of magnitude of axial offset of said head from the instantaneous center of tilt afforded to said stem by reason of the resilient-bushing support thereof, whereby said spherical surfaces will not substantially oppose tilt of said stem even when the fully advanced piston is reached.

28. In combination, a pressure container comprising an elongate cylindrical body with a closed upper end, dispensing-valve means in said upper end, a piston having a closed upper end and integral body structure extending downwardly within a cylinder spaced from the container wall, said piston including a peripherally continuous relatively thin flexible tubular band integrally uniting and axially spacing said upper end from said downwardly extending body structure, said tubular band being of axial extent substantially exceeding its radial thickness and in light peripherally continuous piston-piloting and sealing contact with the container wall, and said upper end and downwardly extending body structure each being of peripheral extent less than the peripheral extent of the inner wall of said container, whereby a product chamber is defined in the container space between the piston band and the valved end of the container, and pressure-sealing means closing the lower end of said container to define a pressure chamber beneath said piston, and further whereby when said product chamber is loaded with product and the lower end of said container is subjected to a charge of gas under pressure said band will be pressure-loaded in the direction of enhanced sealing contact with the container wall.

29. The combination of claim 28, in which said closed upper end includes a thin flexible outer annulus which is continuously formed as the upper end portion of said thin flexible tubular band.

30. A piston for a pressurized container having a viscous product and provided with a dispensing valve, said piston being a single injection-molded plastic article and comprising a piston body of generally tubular configuration and closed at its upper end and open at its lower end, the tubular portion of said piston body comprising a relatively thin resilient first circumferential tubular band of large continuously smooth surface area and predetermined length near said closed end and a less flexibly yieldable second circumferential tubular band of predetermined length near the open end, said bands being serially continuously formed and axially connected to comprise and define substantially the entire axial length of the tubular portion of said piston body, said first band being substantially more axially extensive than its radial thickness, and said second band including plural angularly spaced stiffening ribs some of which ribs project inwardly of the inner wall surface of said second band and other of which ribs project outwardly of the outer wall surface of said second band, whereby, with said piston in a suitable product-loaded container wherein said second band has short clearance with the inner wall of the container, and when the space beneath the piston is subjected to a predetermined charge of gas under pressure, said first band will be radially expanded into pressure-loaded peripherally and axially continuous light sealing and stabilizing contact with the container wall and said second band will have less than circumferentially continuous but nevertheless stabilizing contact with the container wall.

31. A piston for a pressurized container having a viscous product and provided with a dispensing valve, said piston being a single injection-molded plastic article and comprising a piston body of generally tubular configuration and closed at its upper end and open at its lower end, the tubular portion of said piston body comprising a relatively thin resiliently expandable first circumferential tubular band of large continuously smooth surface area and predetermined length near said closed end and a less flexibly yieldable second circumferential tubular band of predetermined length near the open end, said bands being serially continuously formed and axially connected to comprise and define substantially the entire axial length of the tubular portion of said piston body, said first band being substantially more axially extensive than its radial thickness, the maximum unstressed peripheral extent of said first band exceeding the maximum unstressed peripheral extent of said second band; whereby, with said piston in a suitable product-loaded container wherein the container inner wall is of size for continuous first-band contact when the space beneath the piston is subjected to a predetermined charge of gas under pressure, said first band will be radially expanded into pressure-loaded peripherally and axially continuous light sealing and stabilizing contact with the container wall and said second band will have less than circumferentially continuous but nevertheless stabilizing contact with the container wall.

32. The piston of claim 31, wherein the external periphery of said second band is continuous and of radius less than the unstressed external periphery of said first band.

33. The piston of claim 32, wherein the radial thickness of said second band is substantially greater than that of said first band.

34. A piston for a pressurized container having a viscous product and provided with a dispensing valve, said piston being a single injection-molded plastic article and comprising a piston body of generally tubular configuration and closed at its upper end and open at its lower end, the tubular portion of said piston body comprising a relatively thin resiliently expandable first circumferential tubular band of large continuously smooth surface area and predetermined length near said closed end and a less flexibly yieldable second circumferential tubular band of predetermined length near the open end, said bands being serially continuously formed and axially connected to comprise and define substantially the entire axial length of the tubular portion of said piston body, said first band being substantially more axially extensive than its radial thickness, the maximum radially expandable peripheral extent of said first band exceeding the maximum unstressed peripheral extent of said second band; whereby, with said piston in a suitable product-loaded container wherein the container inner wall is of size for continuous first-band contact and for less than continuous second-band contact when the space beneath the piston is subjected to a predetermined charge of gas under pressure, said first band will be radially expanded into pressure-loaded peripherally and axially continuous light sealing and stabilizing contact with the container wall and said second band will nevertheless have stabilizing contact with the container wall.

35. The piston of claim 34, wherein the external periphery of said second band is characterized by plural radial projections at spaced angular locations.

36. A piston for a pressurized container having a viscous product and provided with a dispensing valve, said piston being a single injection-molded plastic article and comprising a piston body consisting of an end-closing head part and axially spaced first and second tubular tail parts; said first tubular part being circumferentially continuously connected at its head end to said head part and comprising a relatively thin expandable first circumferential band of predetermined axial length near said head part, said axial length substantially exceeding the radial thickness of said first band, and said first band being adapted to provide, in pressurized assembly to the bore of a cylindrical container, a large continuously smooth pressure-inflated contour-adapting sealing contact with the container bore; said second tubular part including a second band defining the axially open tail of said piston, said second tubular part being connected at its head end to the tail end of said first tubular part and including plural angularly spaced longitudinal ribs extending continuously from said first band to the tail end of said piston.

37. The piston of claim 36, wherein said second tubular part includes at the tail end a plurality of angularly spaced radially outwardly extending ribs of unstressed radial extent greater than that of said second band.

* * * * *